United States Patent [19]

Stanton

[11] Patent Number: 4,563,869

[45] Date of Patent: Jan. 14, 1986

[54] ROPE WITH REDUCED LASH-BACK CONSTRUCTION

[75] Inventor: Robert L. Stanton, Honesdale, Pa.

[73] Assignee: American Manufacturing Company, Inc., Honesdale, Pa.

[21] Appl. No.: 378,908

[22] Filed: May 17, 1982

[51] Int. Cl.[4] ..... D07B 1/02; D07B 5/00

[52] U.S. Cl. ..... 57/211; 57/225; 57/238; 57/244; 57/240; 57/229

[58] Field of Search ..... 57/200, 210, 211, 225, 57/229, 231, 238, 240, 244, 249

[56] References Cited

U.S. PATENT DOCUMENTS

| | | | |
|---|---|---|---|
| 3,026,669 | 3/1962 | Stanton | 57/211 |
| 3,251,178 | 5/1966 | Stirling | 57/211 X |
| 3,323,301 | 6/1967 | Jackson | 57/211 |
| 3,358,434 | 12/1967 | McCann | 57/211 |
| 3,383,849 | 5/1968 | Stirling | 57/211 |
| 3,625,809 | 12/1971 | Caroselli | 57/229 X |
| 3,968,725 | 7/1976 | Holzhauer | 57/244 X |
| 4,034,547 | 7/1977 | Loos et al. | 57/211 |
| 4,106,276 | 8/1978 | Hosoya | 57/211 |
| 4,321,854 | 3/1982 | Foote et al. | 87/6 |

*Primary Examiner*—Donald Watkins
*Attorney, Agent, or Firm*—Nelson E. Kimmelman

[57] ABSTRACT

A synthetic plastic rope includes a selected number of first components having a relatively high elongation characteristic and second components whose elongation characteristic is considerably lower. In one form of the invention, the rope has a central core in which the first components are located, and a plurality of surrounding strands principally constituted of second components. In other forms, the rope does not have a core and there are a plurality of strands braided (plaited) or laid (twisted) together primarily consisting of the low elongation components, but having high elongation components distributed substantially symmetrically and which in the aggregate have substantially less mass than the low elongation components.

18 Claims, 6 Drawing Figures

ROPE WITH REDUCED LASH-BACK CONSTRUCTION

BACKGROUND OF THE INVENTION

A. Field of the Invention

This invention relates to cordage and in particular to heavy duty marine ropes with novel safety features to prevent harm to personnel upon rope rupture.

B. Prior Art

Ropes have been made for various purposes including safety. For example, U.S. Pat. No. 3,415,052 to the present inventor was specifically designed to be used with automatic winching machines which themselves are adapted to reduce some safety hazards. That patent taught a construction in which a rope had a central core with high tensile characteristics and a plurality of outer strands, also with high tensile characteristics.

U.S. Pat. No. 3,026,669, also to the present inventor, was specifically designed to reduce the safety hazard that resulted when the tension on a rope increased so much that increased pressure caused its synthetic material to melt and to stick momentarily until increased winching would dislodge it suddenly.

In recent years, despite all the advantages of synthetic ropes over older ropes fashioned of natural materials, some disadvantages became apparent. If a synthetic rope was subjected to very high tension and ruptured suddenly, those standing in alignment with the broken rope stood a good chance of being seriously injured and, in some cases, killed. Since all of the components of the rope broke substantially simultaneously, the two severed parts of the rope immediately flew generally away from the rupture point with tremendous force resulting in serious safety hazards.

It is therefore among the objects of the present invention to provide a rope made of synthetic material which considerably reduces the danger inherent in those synthetic ropes all of whose components rupture substantially simultaneously under great tension.

BRIEF SUMMARY OF THE INVENTION

A multi-component rope primarily of synthetic materials comprising a selected number of components having high elongation characteristics and a selected number of second components having relatively low elongation characteristics, the mass of the latter components preponderating.

DETAILED DESCRIPTION OF THE DRAWINGS

Figure 1:
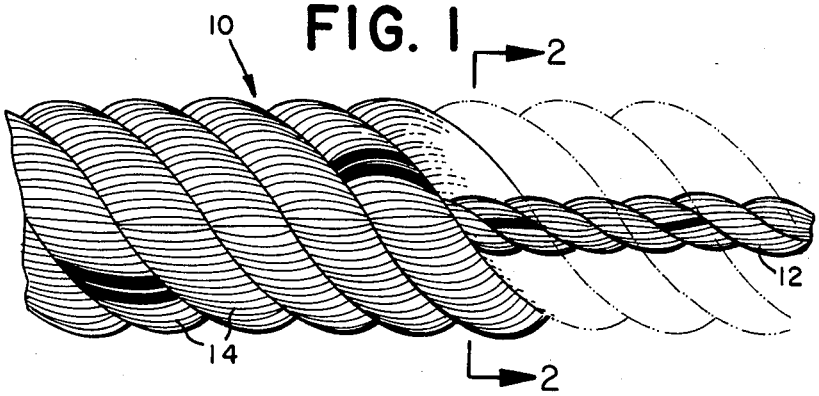
FIG. 1 is a side elevational view, partly broken away, showing one form of the invention as embodied in a rope having a central core.
Figure 2:
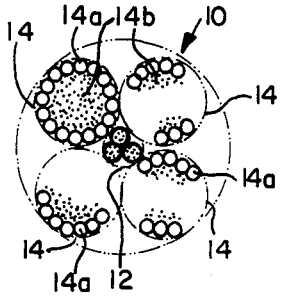
FIG. 2 is a simplified schematic cross-section of the rope shown in FIG. 1 taken along the section line 2—2 in the direction indicated in FIG. 1.

Referring first to FIGS. 1 and 2, there is a rope 10 shown which comprises a central core 12 about which are twisted four rope strands indicated generally at the numeral 14. The core 12 itself is a smaller three-strand rope made of a synthetic material with a high stretch characteristic. Such characteristic may be obtained by employing yarns of polyester, nylon, either of continuous or multi-filamentary construction, for example.

Each outer strand 14 comprises a plurality of cover yarns indicated at **14*a* having good abrasion and ultraviolet resistance. Polyester is a synthetic material which possesses both of these advantages. Each rope strand 14 also includes a central core 14*b*** of yarns composed of a type of fiber which is chosen to have high tensile strength, but whose stretch characteristics are relatively low. One such material is "Kevlar", a high tensile strength, low stretch, organic aramid fiber manufactured by E. I. DuPont De Nemours, Inc.

By the use of a rope containing fibers having both low elongation characteristics and high elongation characteristics, yet possessing great tensile strength, injuries to operating personnel upon rope rupture can be considerably reduced. Such reduction occurs because of two factors. First, when the rope starts to rupture, it is the low elongation components, i.e., the outer strands 14, which break first. Second, the core 12 has high elongation characteristics so that even when the outside strands 14 have broken or are beginning to break, the core will tend to prevent the breaking outside strands from lashing back despite the severing of the outside strands. Ordinariliy, if the core 12 of high stretch material was not present, the outer yarns would snap back or lash back with great force on rupture. After the outside strands have ruptured, untwisted and finally come substantially to rest, the subsequent break of the center core which is of considerably lesser mass will have prevented dangerous lash-back. The previously broken outer strands, constituting the bulk of the entire rope, have already lost most of their momentum and the relatively small mass of the core limits its snap-back inertia to such extent that the snap back of the total rope on total rupture is insufficient to cause serious bodily harm.

In choosing the particular low stretch components and high stretch components, various considerations should be taken into account. Of course, the low stretch component must break before the high stretch components but, more specifically, the time interval between their respective breaks must be sufficient to permit substantial relaxation of the ruptured low stretch components before rupture of the high stretch components. Furthermore, the mass of the earlier breaking low stretch components must be great enough relative to the mass of the high stretch components so that when the former have relaxed after rupture, they can contain or control the mass of the later-breaking high stretch components.

The low stretch components furthermore must be designed to be in a position relation to the high stretch components that they will sufficiently control and contain the high stretch components when the latter break. Moreover, the high stretch components must have sufficient mass to maintain their structural integrity when the low stretch components break, i.e., the high stretch components must remain intact until the low stretch components have broken and relaxed sufficiently.

The rope 10 shown in FIGS. 1 and 2 has the following specifications:

Outer Strands—4 at a lay of 3.5 inches

Cover yarns—44, Type 77 DuPont Dacron—11,000 denier, zero twist

Outer strand core—78 yarns of 15,000 denier DuPont Kevlar 29, zero twist. Each yarn has 10,000 $1\frac{1}{2}$ denier filaments.

Rope Core—$\frac{3}{8}$" diameter, 3 strands, medium lay, each comprising 10 ends (yarns) each containing 192 filaments. The filaments are 1000 denier, zero twist continuous filament nylon. Pitch of ends=32 per foot. The pitch of the strands is 18 turns per foot.

Lay of Rope—4.00 inches

In the rope shown in FIG. 1, the ratio of the total denier of the 3-strand core 12 without the twist factored in the calculation relative to the total denier of the four outer strands 14 was 1:14.8. The ratio of the total weight of the core strands to the total weight of the outer strands, based on a one-foot length, was 1:14.72. This ratio was found to give highly satisfactory results in experimental use, although ratios of up to about 1:15 are considered acceptable as well.

Of course, other materials than nylon may be used for the basic core material. Certain multi-filament types of polypropylene or polyester also possess great elongation characteristics. Also, certain undrawn or partially drawn fibers may be substituted for nylon as they, not having been fully drawn, can be stretched a great deal to their drawn state before their tensile limits are tested.

As the main constituent of the outer strands, Kevlar and carbon fibers which presently are relatively expensive, could be replaced by glass fibers and certain polyester, polyethylene or polypropylene monofilamentary plastics provided they bear the correct elongation characteristics relative to those of the material in the core.

The approximate maximum effective elongation ratio of the elongation characteristics of the low stretch components to those of the high stretch components should be 2:3. In other words, the low stretch components should not have elongation characteristics exceeding approximately 67% of the elongation characteristics of the high stretch materials. While this ratio is a useful general measure, it should be recognized that more than just the inherent elongation characteristics of the materials of the components themselves determine the relative rupture times of the low stretch and high stretch materials. Even if the elongation characteristics of the materials of the components were to be exceeded, a successful rope might nevertheless be possible. For example, if yarns of a certain material are considerably more twisted than other yarns of the same material, the former will have, effectively, a later breaking time than the latter. Or if filaments in certain yarns of a specified material have initially been drawn much less than those in other yarns, the former will have, effectively, a later breaking time than the latter. Many other factors also affect relative breaking times of rope materials.

Figure 3:
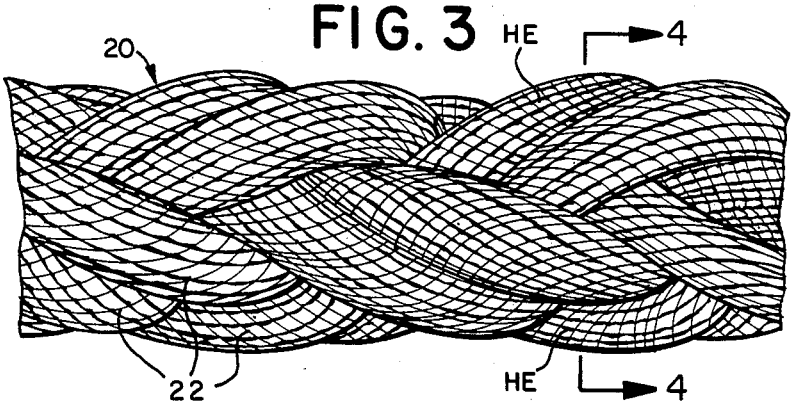
FIG. 3 is a side elevation view of another form of the present invention showing a multi-strand rope without a core.
Figure 4:
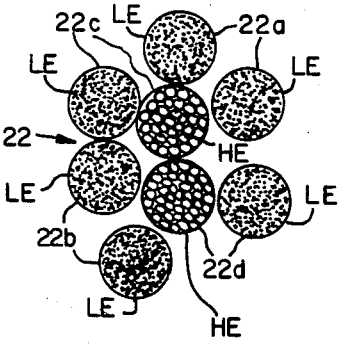
FIG. 4 is a simplified schematic cross-section view of the rope shown in FIG. 3 taken along the section line 4—4 of FIG. 3 in the direction indicated.

A second embodiment of the present invention is shown in FIGS. 3 and 4 wherein a "4×2" plaited synthetic rope 20 is shown. It comprises eight strands, i.e., four pair of two strands each, that are braided or plaited together and does not have a core. Two opposite pairs designated 22*a*, 22*b* (LE) are made principally of low elongation materials as discussed above. The other pairs 22*c*, 22*d* have one low elongation and one high elongation strand each. The "HE" strands are the ones which will prevent complete rupture of the rope when the other "LE" strands, having considerably lower stretch characteristics, first break under sufficient load. The "HE" strands will continue to elongate until after the other six "LE" strands have ruptured and have untwisted and relaxed, having lost most of their kinetic energy. Under continuing high tensile load, the two HE strands will break, but since the other six LE strands, which comprise the bulk or mass of the rope have come substantially to rest and are intertwined with the HE strands, the latter will control and contain the two HE strands thus preventing excessive snap-back problems.

As shown, the two HE strands are disposed 180° apart in alternating pairs. Of course, more than two HE strands could be employed, but to maintain balance and help maintain structural integrity of the rope as a whole they should be distributed relatively symmetrically.

Figure 5:
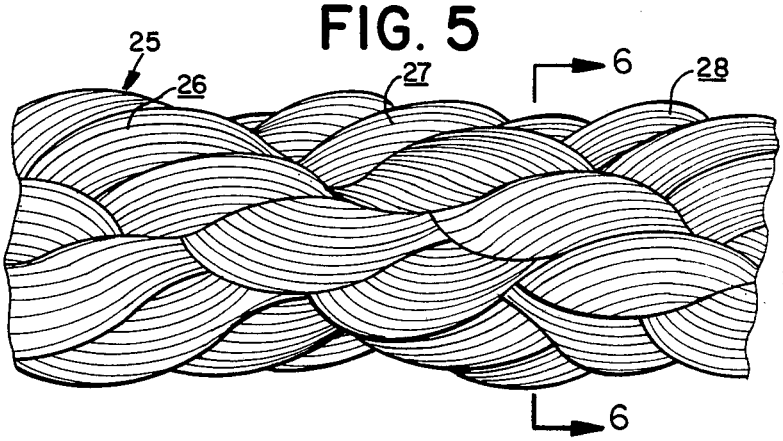
FIG. 5 is a side elevation view of still another embodiment of the present invention depicting a multi-strand, coreless rope.
Figure 6:
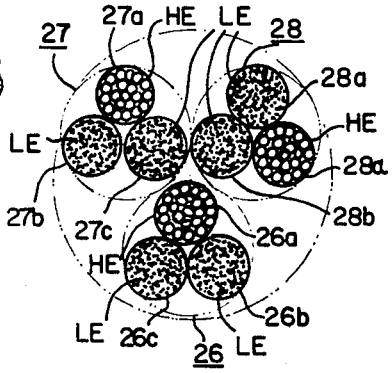
FIG. 6 is a simplified schematic cross-sectional view of the rope shown in FIG. 5 taken along the section line 6—6 in FIG. 5 in the direction indicated.

A third embodiment is shown in FIGS. 5 and 6. This shows a rope 25 of the 3×3 type construction such as is available commercially by the above mentioned American Manufacturing Company under the designation PNX KNO-KINK and the SSR series. It consists of three twisted rope strands 26, 27, 28, each such strand in turn being made of three smaller individual strands ("sub strands") 26*a*, 26*b*, 26*c*; 27*a*, 27*b*, 27*c*; and 28*a*, 28*b*, 28*c* in a cable-lay configuration. This type of rope is made in two operations: (1) three sets of three individual sub-strands are helically laid to form three identical links of a conventional three strand rope, then (2) the three identical ropes are, in turn, helically laid to form the composite 9 strand cable-laid rope.

In order to achieve the desired low lash-back performance from this type of rope, one individual sub-strand 26*a*, 27*a* and 28*a* designated "HE" from each of the three rope strands 26, 27, 28 is principally composed of high stretch components whereas the other two individual sub-strands are composed of low stretch components. As in the case of the first two embodiments illustrated above, the low stretch individual sub-strands will break and come to rest before the high stretch individual sub-strands. When the latter break, the bulk or mass of the low stretch individual sub-strands will contain and control the inertia of the high stretch sub-strands thereby preventing serious snap-back problems.

What is claimed is:

1. A multi-component rope comprising:

(a) a selected number of first components having first predetermined elongation characteristics, and (b) a selected number of second components having second predetermined elongation characteristic which are considerably lower than said first elongation characteristics, said second components having an aggregate mass which is considerably greater than the aggregate mass of said first components.

2. A multi-component rope comprising:

(a) a selected number of first components having first predetermined elongation characteristics, and (b) a selected number of second components having second predetermined elongation characteristics which are considerably lower than said first characteristics, the maximum effective ratio of the first elongation characteristics to the second elongation characteristics being approximately 3:2, said second components having an aggregate mass which is considerably greater than the aggregate mass of said first components.

3. The rope according to claims 1 or 2 wherein said first components are formed substantially to maintain their structural integrity after rupture of said second components under tension and until the latter have substantially relaxed.

4. The rope according to claims 1 or 2 wherein said first components are principally constituted in a central core and wherein said second components are principally contained in a predetermined number of outer strands disposed around said central core.

5. The rope according to claim 4 wherein said central core has a plurality of strands and wherein said predetermined number of outer strands is at least four.

6. The rope according to claim 5 wherein said outer strands also include a plurality of cover yarns made of a material having high abrasion resistance characteristics.

7. The rope according to claim 6 wherein said central core is made principally of a synthetic plastic material of the class including nylon and polyester.

8. The rope according to claim 7 wherein said outer strands are made principally of fibers chosen from the class including high tensile strength, low stretch organic aramid, carbon, polypropylene, polyethylene and glass.

9. The rope according to claim 8 wherein said aramid fibers are principally Kevlar and wherein said core material is principally continuous filament nylon.

10. The rope accordinag to claims 1 or 2 wherein said rope comprises an even number of strands greater than two and wherein said first components are distributed substantially symmetrically in selected ones of said strands.

11. A multi-component rope comprising:

(a) an even number of strands greater than two, said strands being plaited in pairs, said strands having first components with first predetermined elongation characteristics distributed substantially symmetrically in selected ones of said strands, said selected strands being disposed substantially opposite one another, and (b) selected number of second components having a second predetermined elongation characteristics which are considerably lower than said first elongation characteristics, said second components having an aggregate mass which is considerably greater than the aggregate mass of said first components.

12. The rope according to claim 10 wherein said rope has no center core.

13. The rope according to claims 1 or 2 comprised of a predetermined number of strands twisted together, each of said strands including a predetermined number of smaller sub-strands, selected ones of said sub-strands in selected ones of said strands having said first elongation characteristics and selected other ones of said sub-strands in said selected strands having said second elongation characteristics.

14. The rope according to claim 13 wherein the number of said selected sub-strands having said first elongation characteristics is substantially less than the number of said selected other sub-strands having said second elongation characteristics.

15. The rope according to claim 13 wherein there are at least three of said selected substrands which have said first elongation characteristic and wherein there are at least six of said selected other sub-strands having said second elongation characteristic.

16. A multi-component rope comprising:

(a) an even number of strands greater than two which are plaited in pairs, (b) a selected number of first components having first predetermined elongation characteristic, said first components being distributed substantially symmetrically in selected ones of said strands which are disposed substantially opposite one another, and (c) a selected number of second components having second predetermined elongation characteristics which are considerably lower than said first characteristics, a maximum effective ratio of the first elongation characteristics to the second elongation characteristic being approximately 3:2.

17. The rope according to claim 16 wherein said rope has no center core.

18. The rope according to claim 13 which has no center core independent of and disposed centrally with respect to said predetermined number of strands.

* * * * *